US005123485A

United States Patent [19]

Vasicek et al.

[11] Patent Number: 5,123,485

[45] Date of Patent: Jun. 23, 1992

[54] METHOD OF FLOWING VISCOUS HYDROCARBONS IN A SINGLE WELL INJECTION/PRODUCTION SYSTEM

[75] Inventors: Steve L. Vasicek, Yorba Linda; John H. Duerksen, Fullerton, both of Calif.

[73] Assignee: Chevron Research and Technology Company, San Francisco, Calif.

[21] Appl. No.: 447,774

[22] Filed: Dec. 8, 1989

[51] Int. Cl.[5] ..... E21B 43/24; E21B 43/40

[52] U.S. Cl. ..... 166/267; 166/272; 166/303

[58] Field of Search ..... 166/250, 251, 252, 258, 166/263, 267, 268, 269, 272, 297, 298, 302, 303, 304, 306, 313, 369, 370, 382, 52, 57, 62, 106, 191, 902

[56] References Cited

U.S. PATENT DOCUMENTS

| | | | |
|---|---|---|---|
| 3,126,961 | 3/1964 | Craig, Jr. et al. | 166/302 |
| 3,349,846 | 10/1967 | Trantham et al. | 166/258 X |
| 4,224,993 | 9/1980 | Huckaby | 166/304 X |
| 4,362,213 | 12/1982 | Tabor | 166/267 |
| 4,407,367 | 10/1983 | Kyold | 166/267 |
| 4,595,057 | 6/1986 | Deming et al. | 166/269 |
| 4,601,338 | 7/1986 | Prats et al. | 166/278 |
| 4,753,293 | 6/1988 | Bohn | 166/267 |

*Primary Examiner*—William P. Neuder

*Attorney, Agent, or Firm*—Edward J. Keeling; Robert D. Touslee; David J. Power

[57] ABSTRACT

A method of heating produced fluid in a wellbore having multiple tubing strings. In the portion of the wellbore above the dual-string packer a portion of hot injection fluid is selectively flowed from the injection tubing string into the casing annulus where the production tubing is heated, and the flowing viscosity of fluids therein is lowered.

5 Claims, 1 Drawing Sheet

METHOD OF FLOWING VISCOUS HYDROCARBONS IN A SINGLE WELL INJECTION/PRODUCTION SYSTEM

BACKGROUND OF THE INVENTION

This invention relates generally to the production of viscous hydrocarbons from subterranean hydrocarbon-scontaining formulations. More specifically, it relates to the control of flowing viscosity of produced fluids within a wellbore. Deposits of highly viscous crude petroleum represent a major future resource in the United States in California and Utah, where estimated remaining-in-place reserves of viscous or heavy oil are approximately 200,000,000 barrels. Overwhelmingly, the largest deposits in the world are located in Alberta Province, Canada, where the in-place reserves approach 1,000 billion barrels from depths of about 2,000 feet to surface outcroppings and occurring at viscosities in excess of 1,000,000,000 cp at reservoir temperature. Until recently, the only method of commercially recovering such reserves was through surface mining at the outcrop locations. It has been estimated that about 90% of the total reserves are not recoverable through such mining operations. U.S. Pat. No. 4,037,658 to Anderson teaches a method of assisting the recovery of viscous petroleum, such as from tar sands, by utilizing a controlled flow of hot fluid in a flow path within the formation but out of direct contact with the viscous petroleum; thus, a solid-wall, hollow, tubular member in the formation is used for conducting hot fluid to reduce the viscosity of the petroleum to develop a potential passage in the formation outside the tubular member into which a fluid is injected to promote movement of the petroleum to a production position.

The method and apparatus disclosed by the Anderson '658 Patent and related patents is effective in establishing and maintaining communications within the producing formation, and has been termed the "Heated Annulus Steam Drive," or "HASDrive method." In the practice of HASDrive, a hole is formed in the petroleum-containing formation and a solid-wall, hollow, tubular member is inserted into the hole to provide a continuous, uninterrupted flow path through the formation. A hot fluid is flowed through the interior of the tubular member out of contact with the formation to heat viscous petroleum in the formation outside the tubular member to reduce the viscosity of at least a portion of the petroleum adjacent the outside of the tubular member to provide a potential passage for fluid flow through the formation adjacent the outside of the tubular member. A drive fluid is then injected into the formation through the passage to promote movement of the petroleum for recovery from the formation.

Parallel tubing strings, the apparatus disclosed in U.S. Pat. No. 4,595,057 to Deming et al, is a configuration which at least two tubing strings are placed parallel in the wellbore casing. Parallel tubing has been found to be superior in minimizing scaling and heat loss during thermal well operation.

U.S. Pat. No. 5,014,787 which is assigned to the assignee of the present application and incorporated herein by reference, achieves an improved heavy oil recovery from a heavy oil containing formation utilizing a multiple tubing string completion in a single wellbore, such wellbore serving to convey both injection fluids to the formation and production fluids from the formation. The injection and production would optimally occur simultaneously, in contrast to prior cyclic steaming methods which alternated steam and production from ,a single wellbore. The process disclosed in U.S. Pat. No. 5,014,787 394 is termed the "Single Well Injection/ Production System," or "SWIPS." In the SWIPS process, it is not necessary the wellbore be substantially horizontal relative to the surface but may be at an any orientation within the formation. By forming a fluid barrier within the wellbore between the terminus of the injection tubing string and the terminus of the production tubing string; and exhausting the injection fluid near the barrier while injection perforations are nearer the wellhead, the SWIPS wellbore casing is effective in mobilizing at least a portion of the heavy oil and the formation nearest the casing by conduction heat transfer.

The improved heavy oil production method disclosed by U.S. Pat. No. 5.014,787 is thus effective in establishing communication between the injection zone and production zone through the ability of the wellbore casing to conduct heat from the interior of the wellbore through the heavy oil in the formation near the wellbore. At least a portion of the heavy oil in the formation near the wellbore casing would be heated, its viscosity lowered and thus have a greater tendency to flow. The single well method and apparatus of the SWIPS method and apparatus in operation therefore accomplishes the substantial purpose of an injection well, a production well, and a means of establishing communication therebetween.

Of great concern in the production of viscous hydrocarbons is the potential for flowing hydrocarbons within a tubular member to so cool in temperature as to effectively cease flowing and therefore inhibit further production. Without a means for elevating the temperature of such lowered temperature viscous hydrocarbons within a tubular flow path, viscous hydrocarbon production would be jeopardized. While the oil produced from the hydrocarbon bearing formation is capable of flowing at an elevated temperature, if allowed to cool the fluid viscosity would drastically increase, and production of oil greatly inhibited. One method of insuring the fluid within the production tubing is maintained at a desired elevated temperature is to exhaust a portion of hot injection fluid from the injection tubing to the annulus formed between the casing and the tubing strings and thus conduct heat through the production tubing wall to the produced fluid within the production tubing. By the method of the present invention, a subsurface flow controlled device, such as the "Control-A-Flow Sliding Side Door®" device manufactured by Otis Engineering, or the like, is placed within the injection tubing just above the dual packer. A portion of hot injection fluid would thus be allowed to conduct heat to the production tubing prior to that portion of hot injection fluid being exhausted from the wellbore annulus at the surface. When a desired flowing temperature is achieved in the production tubing, the subsurface flow control device may be closed, and normal injection and production operations in accordance with the SWIPS method resumed.

DESCRIPTION OF THE PREFERRED EMBODIMENT

Figure 1:
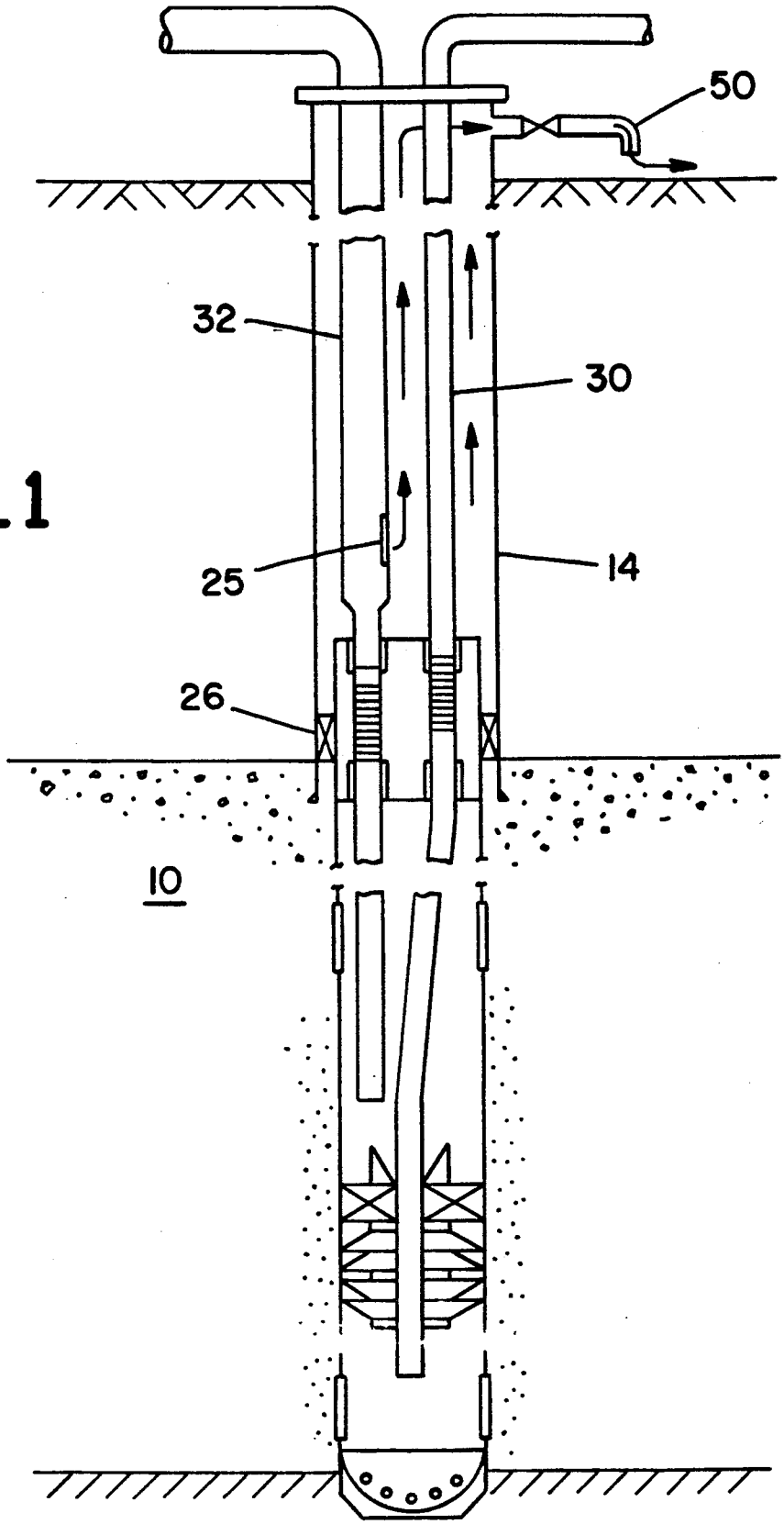
FIG. 1 is an elevation view and cross section of the single well injection and production system, showing the annulus access means on the injection tubing and surface annulus exhaust means.

In the exemplary apparatus for practicing the method of the present invention, as depicted in FIG. 1, an oil bearing subterranean formation 10 is penetrated by a wellbore having a casing 14. The first tubing string 32, and second tubing string 30 are installed within the wellbore casing 14 in accordance with the method disclosed in U.S. Pat. No. 5,014,787 by J. H. Duerksen. Injection tubing string 32 is furnished with a tubing access means 25 for selectively flowing injection fluid from within the injection tubing string 32 into the casing annulus within the wellbore formed by the casing 14, exterior of both tubing strings, the packer 26 and the wellhead at the surface. At the surface, the wellhead is provided with a valve and flow path 50 for allowing fluid flow from the casing annulus to the atmosphere or to a low pressure facility. When injection operations in accordance with the SWIPS method are initiated, tubing access means 25 is opened and valve and flow path 50 are likewise opened to a desired degree in order to flow hot injection fluid within the casing annulus. Temperature of the flowing fluid within the production tubing string may be monitored to determine the desired degree of flow of injection fluid within the casing annulus. Either tubing access means 25 or valve and flow path 50, or both, may be adjusted to control the flow of injection fluid within the casing annulus.

Although the present invention has been described with preferred embodiments, it is to be understood that modifications and variations may be resorted to without departing from the spirit and scope of the present invention, as those skilled in the art will readily understand. Such modifications and variations are considered to be within the purview and scope of the appended claims.

What is claimed is:

1. A method for enhancing the flow of viscous hydrocarbons from a subterranean formation wherein said formation is traversed by a cased wellbore having a first tubing string, a first packer and a second tubing string, a second packer combination therein, said wellbore casing having a thermal communication path lying contiguous with the formation when a drive fluid is injected down said second tubing string and accesses a thermal zone parenthetically defined by said packers, said thermal communication packer directing produced fluids from the formation to said first tubing string for recovery, the improvement comprising:

opening a tubing access means operably connected to said second string;

simultaneously flowing a portion of the drive fluid through said tubing access means and into said wellbore, said drive fluid externally heating said first tubing string and the produced fluids therein;

exhausting the portion of the drive fluid within the wellbore at the surface.

2. The method of claim 1 wherein the injection fluid is steamed.

3. The method of claim 1 wherein the injection fluid is hot water.

4. The method of claim 2 further comprising the step of:

a. controlling the flow of injection fluid within the casing annulus to maintain a predetermined flowing temperature of the fluid within the first tubing string.

5. The method of claim 4 wherein the step of controlling the injection fluid flow within the casing annulus is achieved by throttling the flow of the injection fluid from the casing annulus at the surface.

* * * * *